US006385886B1

(12) United States Patent
Chepikian

(10) Patent No.: US 6,385,886 B1
(45) Date of Patent: May 14, 2002

(54) STACKING PHOTO FRAME STRUCTURE

(76) Inventor: Paul Chepikian, c/o Lupine Productions, 14542 Ventura Blvd., Suite 204, Sherman Oaks, CA (US) 91403

( * ) Notice: Subject to any disclaimer, the term of this patent is extended or adjusted under 35 U.S.C. 154(b) by 0 days.

(21) Appl. No.: 09/506,511

(22) Filed: Feb. 17, 2000

(51) Int. Cl.[7] ..... A47G 1/16
(52) U.S. Cl. ..... 40/729; 40/730; 40/762
(58) Field of Search ..... 446/111, 122, 446/124; 40/729, 730, 611, 761, 762, 763, 764, 731; 403/167, 168, 354, 375

(56) References Cited

U.S. PATENT DOCUMENTS

| | | | | | |
|---|---|---|---|---|---|
| 1,111,923 | A | * | 9/1914 | Silva | 446/111 |
| D142,501 | S | * | 10/1945 | Sherr | 40/729 |
| 2,497,657 | A | * | 2/1950 | Cole | 40/729 |
| 2,499,535 | A | * | 3/1950 | Spreen | 40/729 |
| 3,577,666 | A | * | 5/1971 | Wexler | 40/152 |
| 4,034,496 | A | | 7/1977 | Cohen | |
| 4,115,938 | A | * | 9/1978 | Belmuth et al. | 40/152 |
| 4,202,121 | A | * | 5/1980 | Marvis et al. | 40/152.1 |
| 4,244,127 | A | | 1/1981 | Buzzard | |
| 4,271,618 | A | | 6/1981 | Lyman | |
| 4,319,419 | A | | 3/1982 | Traill | |
| 4,385,459 | A | * | 5/1983 | McGrath et al. | 40/124.4 |
| 4,432,152 | A | | 2/1984 | Daenen | |
| 4,827,639 | A | * | 5/1989 | Wang | 40/152.1 |
| 4,912,863 | A | | 4/1990 | Harvey | |
| 5,281,181 | A | * | 1/1994 | McCollum | 446/106 |
| 5,433,036 | A | * | 7/1995 | Ganal | 40/152.1 |
| 5,588,240 | A | | 12/1996 | Zilliox | |
| 5,617,660 | A | * | 4/1997 | Pollack | 40/611 |
| 6,209,248 | B1 | * | 4/2001 | Reinhard | 40/768 |

* cited by examiner

*Primary Examiner*—Lynne H. Browne
*Assistant Examiner*—Kenn Thompson

(57) ABSTRACT

A stacking modular frame system, assembled on a surface such as a table-top as opposed to being wall-mounted, with the individual frames interconnecting in three-dimensional form horizontally, vertically, or in combination. The structure is supported by long or short caps, which also top the structure to create stability. The caps and the frame fronts and backs all have corresponding notches that fit, each piece into the other, in a perpendicular fashion, thereby building the structure. Beginning with the caps, the structure can be built up multiple levels with multiple frames, each stacking perpendicularly on the previous, and can be built outwardly in the same fashion. The photo is centered naturally within the notches in the separate frame front and back pieces.

2 Claims, 7 Drawing Sheets

STACKING PHOTO FRAME STRUCTURE

BACKGROUND—FIELD OF INVENTION

This invention relates to photograph frames, specifically for framing multiple photos simultaneously and for sitting on table-tops as opposed to being wall-mounted.

BACKGROUND—DESCRIPTION OF PRIOR ART

Although several photograph frames exist that exhibit multiple photos simultaneously, most are unchangeable, or very limited, in their formation possibilities. This limitation restricts the user to a fixed number of photos, or a limited structure for photos. Even if growth is possible within a frame structure, there have been dimensional limitations.

The chain-link method used in U.S. Pat. No. 4,244,127, granted to George Buzzard, only allows the chain of frames to grow in one direction. U.S. Pat. No. 4,271,618, granted to George F. Lyman, has a hinge connecting only two photos, and the angle can be adjusted up to 360 degrees.

The three-dimensional features of U.S. Pat. No. 4,034,496, to Bernard Cohen, does not allow the actual structure to change, but only to place photos closer or further from the viewer within the unchanged structure.

The clip-connections used in U.S. Pat. No. 4,115,938, to Harold M Belmuth, et. al., allow the frame structure to grow, but only two-dimensionally, mounted flat against a wall. U.S. Pat. No. 5,588,240, to Kent Zilliox, allows the same type of flexibility, with puzzle-shape pieces, but again only two-dimensionally, mounted flat against a wall. U.S. Pat. No. 4,912,863, granted to Fitzgerald Harvey uses slots to attach the frames in this two-dimensional manner, and U.S. Pat. No. 4,432,152, to Robert H. C. M. Daenen, creates another method with a hanger/holder for connecting various non-related frames, for an eclectic, hodgepodge effect. Similarly, U.S. Pat. No. 4,319,419, to Gerald Traill, provides a decorative support to suspend a variety of different frames, again mounted flat against a wall.

SUMMARY

The present invention provides a modular photograph frame system with unlimited growth potential, with front and back pieces to sandwich photos between, built on supporting caps which also top the structure for stability, allowing three-dimensional construction, with tremendous flexibility in configuration and size. The system is built on surfaces as opposed to being wall-mounted. Fronts and backs are rectangular, and intersect with the notches perpendicularly with similar notches on the caps or on other frame pieces to connect the pieces as the structure is built. Injection molding provides a recessed indenture in the front and back piece, exactly alike, to place the photo within, and small dimples to gently snap the pieces together, and rounded comers on all right angles. The front pieces are clear plastic, and the back pieces and caps are the same clear plastic, but are also found in colored plastic, wood and metal, for a variety of presentation and decorating options.

OBJECTS AND ADVANTAGES

Several objects and advantages of the current invention are:

(a) to allow the structure to change from time to time, as the photographs exhibited may also be changed;

(b) to provide a very simple connecting mechanism, simultaneously centering the photograph in the frame without the need for additional tools. One advantage of this object is that it is simple to use, and enjoyable for the user to explore the different possible construction options to exhibit photos;

(c) to allow photos of horizontal or vertical exposure to be placed in the structure simultaneously, without limitation to one or the other;

(d) to provide a picture frame system that is pleasing to the eye, with the interlocking portion of the frame and the supports a part of the overall design and appearance;

(e) to allow photos to be viewed from all sides of a structure as it is built on a surface such as a table-top, or at minimum, two perpendicular sides of a structure.

Keeping these objectives in mind, the present invention takes the form of a stacking modular frame system, with the individual frames interconnecting in three-dimensional form horizontally, vertically, or in combination. The stack is supported by long or short caps, which also top the structure to create stability. The caps and the frame fronts and backs all have corresponding notches that fit, each piece into the other, in a perpendicular fashion, thereby building the structure. The photo is centered naturally within the notches in the frame front and back pieces. Further objects and advantages will become apparent from a consideration of the description and drawings provided.

DESCRIPTION

A preferred embodiment of the present invention is in plastic, either cut or manufactured by injection molding. Additional embodiments of the present invention are in fine hardwoods or metal, with the Clear front pieces remaining in plastic.

Figure 1:
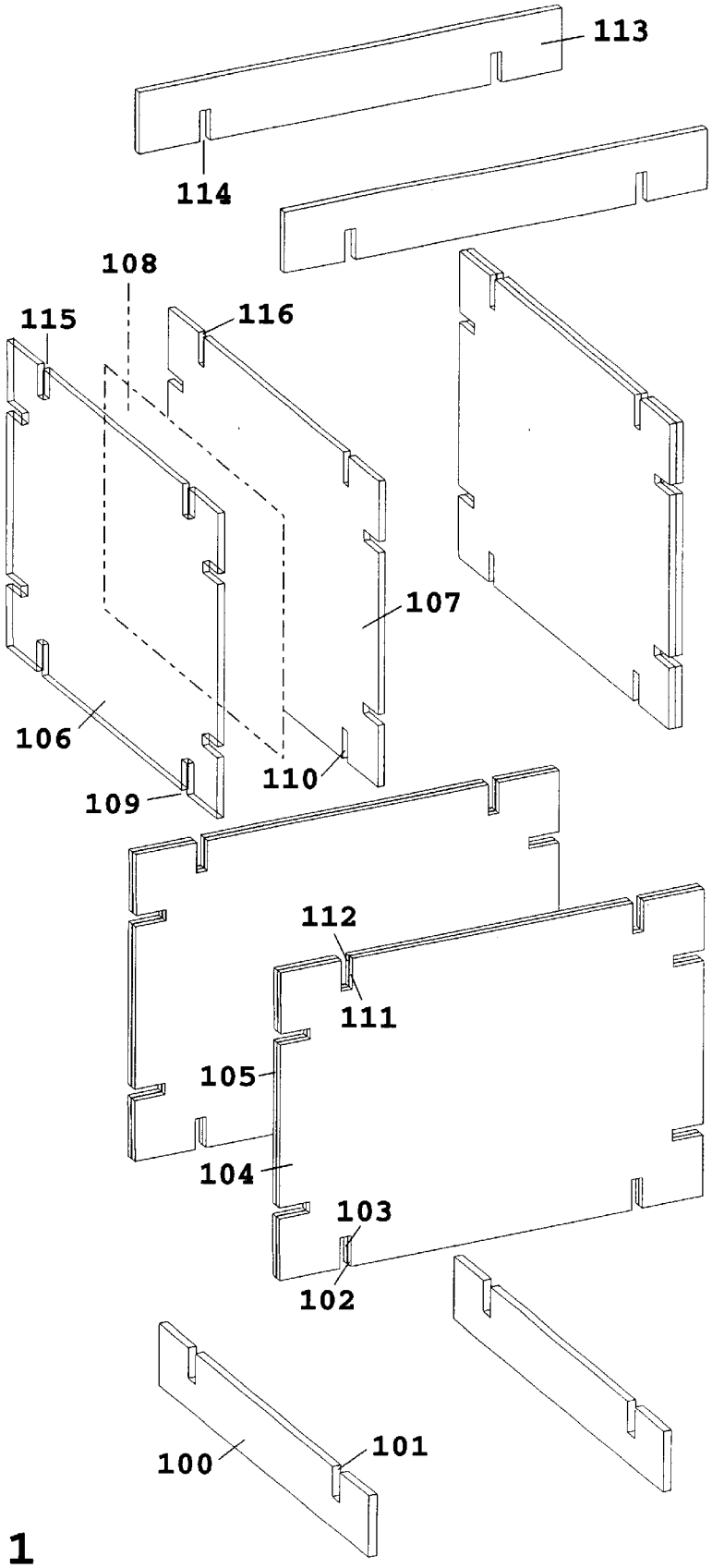
FIG. 1 shows an exploded view of a basic 4-frame system, displaying only horizontal photos, clearly showing how the photograph is placed in the frame.

As in FIG. 1, the front piece 104 is Clear, to view the photo placed within the system. The back piece 105 is Color, although one embodiment is to have the back piece 105 also Clear, thereby giving the illusion of having the photos suspended within the structure, and also allowing for two photos to be placed, back to back, between the Front 104 and Back 105 pieces. This usage will double the number of photos that can be displayed. For simplicity, all operations are discussed with Clear front 104 and Color back 105 pieces.

Caps are provided in short and long lengths, the selection of which allows vertical or horizontal photos to be displayed.

The caps are approximately twice the width of the Clear fronts and the Color backs, which are the same width, making minimal allowances for the width of the photograph sandwiched between the Clear fronts and Color backs.

The notches on all pieces are roughly to ½", deep enough only to align the photo, which fits between the notches on the Clear fronts and Color backs. The dimensions of the Clear fronts and Color backs then, are roughly ½" larger on all four sides than the photograph intended for use.

In the alternative manufacturing method of injection molding, as in FIG. 7, a slight recession is created in the back piece, within which the photo can be placed. The front piece has a like protrusion, so that when the front piece is placed on the back piece, as in FIG. 7E, the photo is secure and the pieces do not slide. There are also slight dimples approximately in the center of each edge of the indenture, allowing the user to gently snap the pieces together, shown in FIG. 7D. Due to the indenture, the notches in this method are roughly ¼" deep on all pieces, and used only to create the structure, not to align the photo.

This manufacturing method also creates rounded corners on all of the pieces, both external corners and internal notches.

Operation—FIG. 1

In FIG. 1, two long caps 100 are placed with the notches 101 facing up, intersecting perpendicularly with the notches 102 and 103, on the Clear fronts 104 and the Color backs 105, respectively, with photos sandwiched between them.

Clear fronts 106 and Color backs 107 are then aligned with horizontal photo 108 sandwiched between, in similar fashion, and intersecting with the notches 109 and 110 perpendicularly on the notches 111 and 112 on the Clear fronts 104 and Color backs 105, respectively, beneath them.

Two long caps 113 are placed with the notches 114 facing down, intersecting perpendicularly with the notches 115 and 116 in the Clear fronts 106 and Color backs 107 beneath them, completing the structure.

In structures such as this which display only horizontal photos, only long caps are used.

FIG. 2

Figure 2:
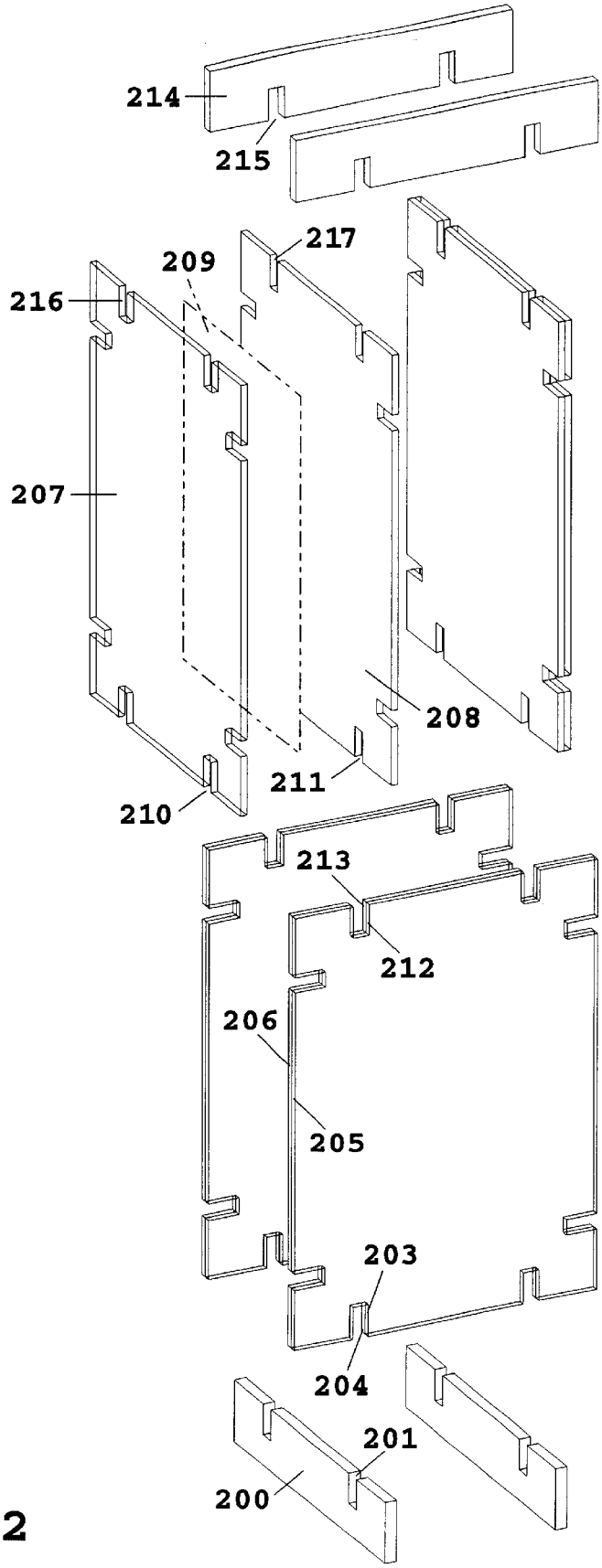
FIG. 2 shows a separated view of the basic 4-frame system, displaying only vertical photos.

In FIG. 2, two short caps 200 are placed with the notches 201 facing up, intersecting perpendicularly with the notches 203 and 204, on the Clear fronts 205 and the Color backs 206, respectively, which are aligned with the vertical photos placed between them.

Clear fronts 207 and Color backs 208 are then aligned with vertical photo 209 placed between them in similar fashion, and intersecting with the notches 210 and 211 perpendicularly on the notches 212 and 213 on the Clear fronts 205 and Color backs 206, respectively, beneath them.

Two short caps 214 are placed with the notches 215 facing down, intersecting perpendicularly with the notches 216 and 217 beneath them, completing the structure.

In structures such as this which display only vertical photos, only short caps are used.

FIG. 3

Figure 3:
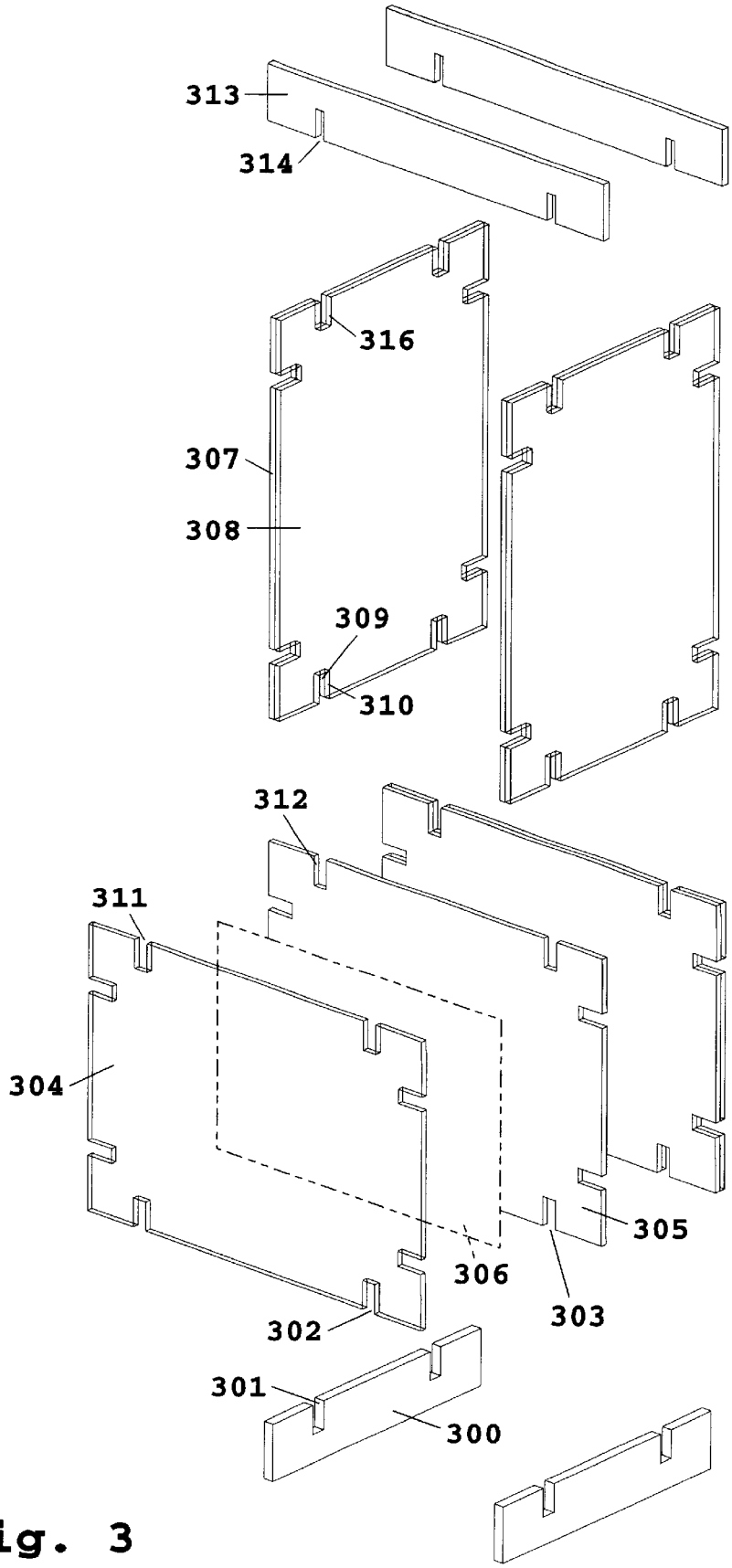
FIG. 3 shows a separated view of the basic 4-frame system combining horizontal and vertical photos.

To combine horizontal and vertical photos, FIG. 3 shows two short caps 300 placed with the notches 301 facing up, intersecting perpendicularly with the notches 302 and 303 on the Clear fronts 304 and Color backs 305, respectively, which are aligned with the horizontal photo 306 placed between them.

Clear fronts 307 and Color backs 308 are then aligned with vertical photos placed between them in similar fashion, and intersecting with the notches 309 and 310 perpendicularly on the notches 311 and 312 on the Clear fronts 304 and Color backs 305, respectively, beneath them.

Two long caps 313 are placed with the notches 314 facing down, intersecting perpendicularly with the notches 315 and 316 on the Clear fronts 307 and Color backs 308 beneath them, completing the structure.

FIG. 4

Figure 4:
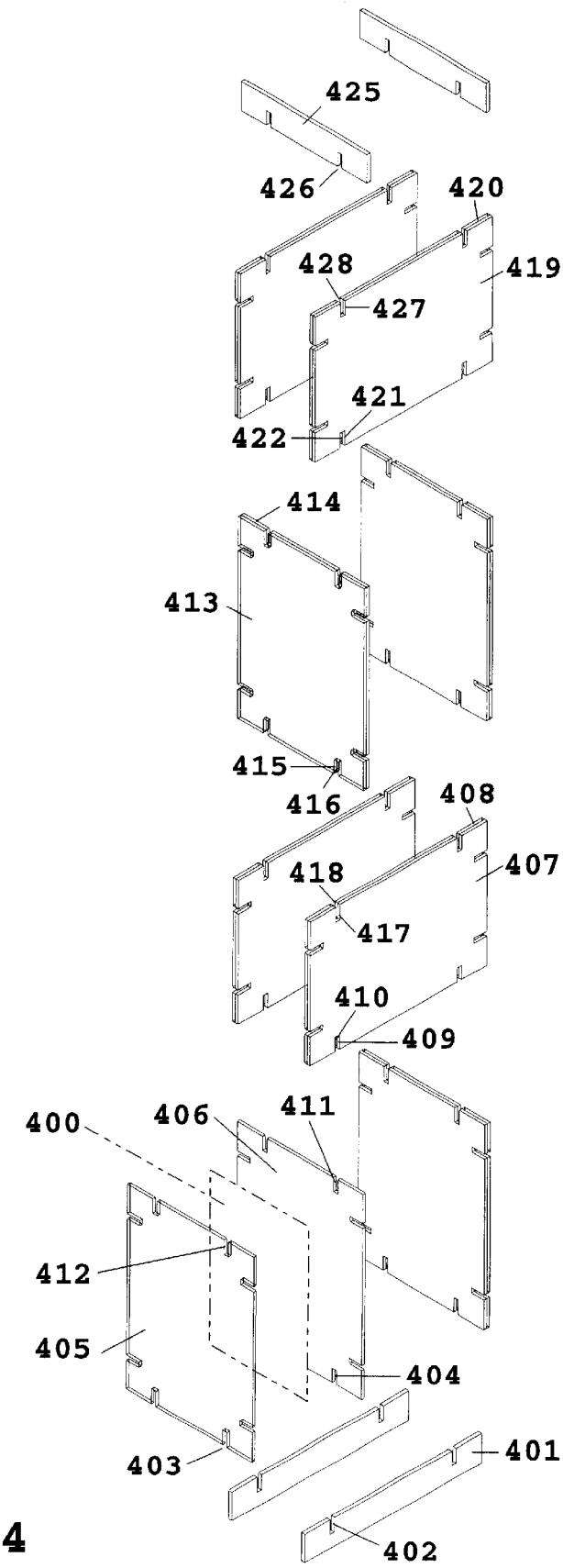
FIG. 4 shows a separated view of a basic 8-frame system, combining vertical and horizontal photos.

To build a larger structure, also combining vertical and horizontal photos, FIG. 4 shows two long caps 401 placed with the notches 402 facing up, intersecting perpendicularly with the notches 403 and 404 on the Clear fronts 405 and Color backs 406, respectively, which are aligned with the vertical photo 400 placed between them.

Clear fronts 407 and Color backs 408 are then aligned with horizontal photos placed between them in similar fashion, and intersecting notches 409 and 410 perpendicularly with notches 411 and 412 on the Clear fronts 405 and Color backs 406, respectively, beneath them.

Clear fronts 413 and Color backs 414 are then aligned with vertical photos placed between them in similar fashion, and intersecting notches 415 and 416 perpendicularly with notches 417 and 418 on the Clear fronts 407 and Color backs 408, respectively, beneath them.

Clear fronts 419 and Color backs 420 are then aligned with horizontal photos placed between them in similar fashion, and intersecting notches 421 and 422 perpendicularly with notches 423 and 424 on the Clear fronts 413 and Color backs 414, respectively, beneath them.

Two short caps 425 are placed with the notches 426 facing down, intersecting perpendicularly with the notches 427 and 428 on the Clear fronts 419 and Color backs 420 beneath them, completing the structure.

FIG. 5

Figure 5:
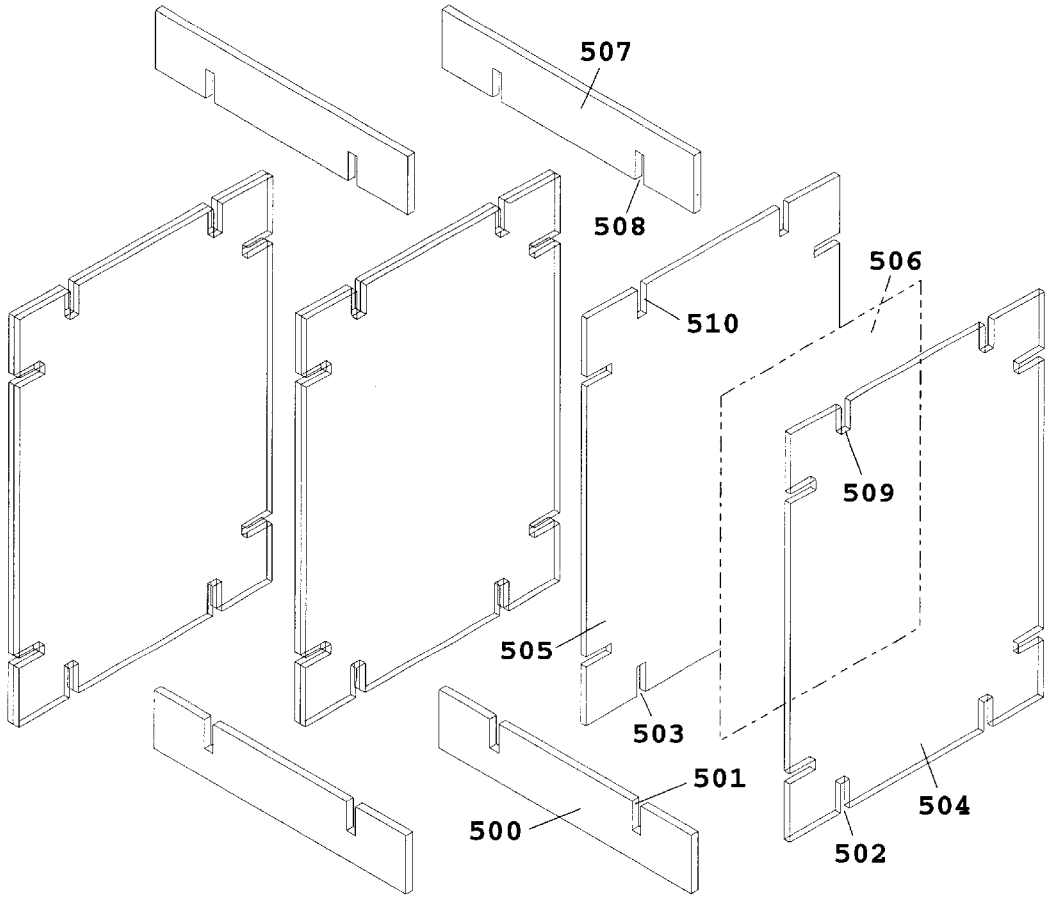
FIG. 5 shows a separated view of a small vertical photo accordion structure.

For the accordion structure for vertical photos, FIG. 5 shows two short caps 500 placed with the notches 501 facing up, intersecting perpendicularly with the notches 502 and 503 on the Clear fronts 504 and Color backs 505, respectively, which are aligned with the vertical photo 506 placed between them.

This construction shows three photographs, placed in an off-center, parallel manner, spaced with two short caps 500 below.

Two short caps 507 are placed with the notches 508 facing down, intersecting perpendicularly with the notches 509 and 510 on the Clear fronts 504 and Color backs 505 beneath them, completing the structure.

In structures such as this which display only vertical photos, only short caps are used.

FIG. 6

Figure 6:
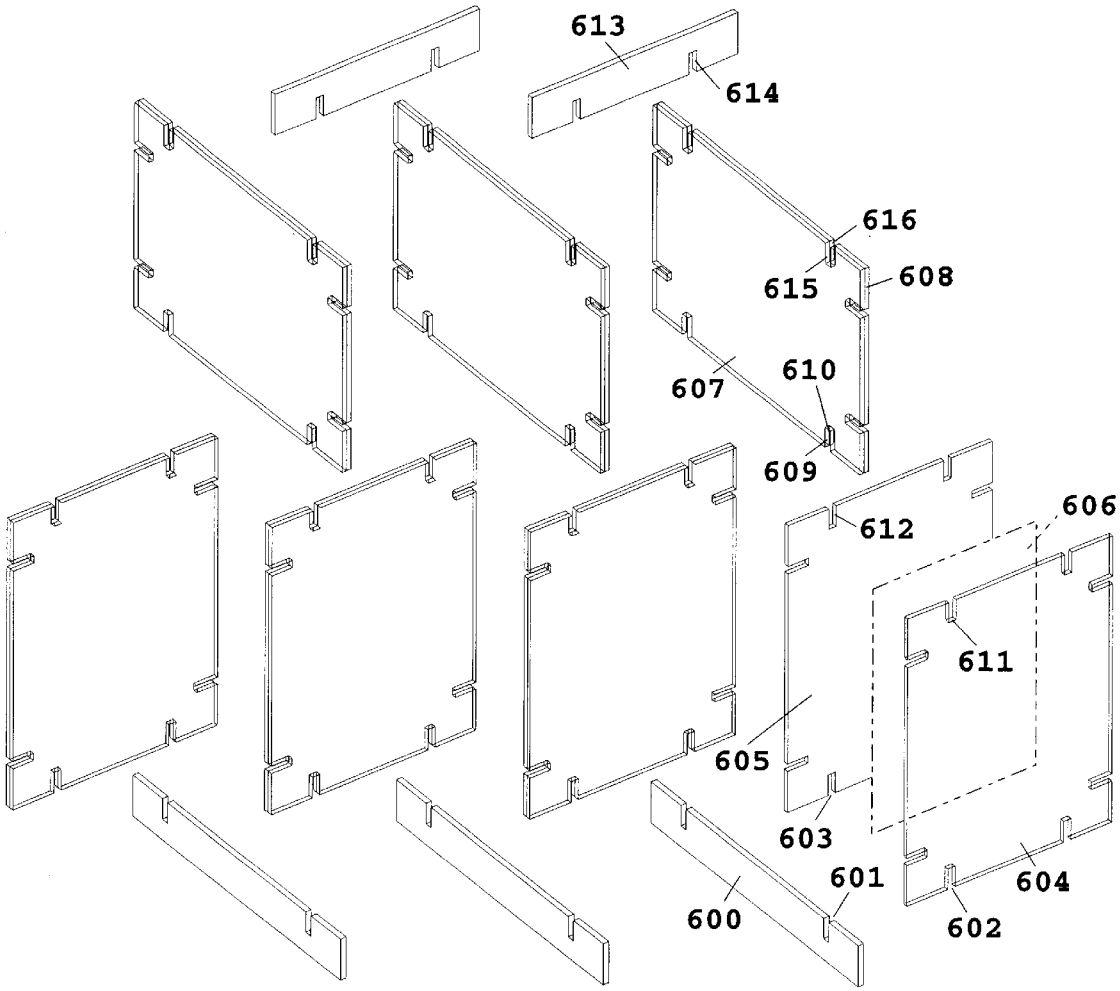
FIG. 6 shows a separated view of a larger, combination vertical and horizontal photo accordion structure.

For the larger accordion structure combining vertical and horizontal photos, FIG. 6 shows three long caps 600 placed with the notches 601 facing up, intersecting perpendicularly with the notches 602 and 603 on the Clear fronts 604 and Color backs 605, respectively, which are aligned with the vertical photo 606 placed between them.

This construction shows four photographs, placed in an off-center, parallel manner, spaced with three long caps 600 below as the basis for the remainder of the structure.

Three horizontal photos are placed between three Clear fronts 607 and Color backs 608, and are placed with the notches 609 and 610 fitting perpendicularly into the notches 611 and 612 of the Clear fronts 604 and Color backs 605 beneath them.

Two short caps 613 are placed with the notches 614 facing down, intersecting perpendicularly with the notches 615 and 616 on the Clear fronts 607 and Color backs 608 beneath them, completing the structure.

FIGS. 7A–7E

Figure 7A:
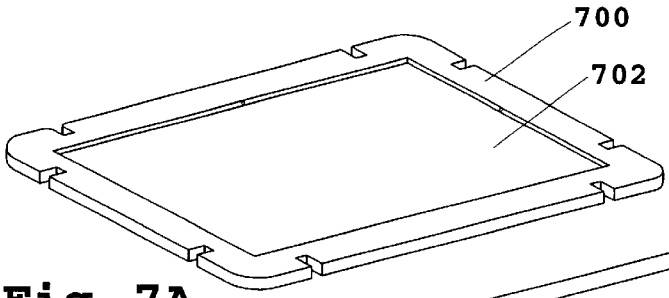
FIG. 7 shows a variation with a recessed area for the photo, and curved corners.
Figure 7B:
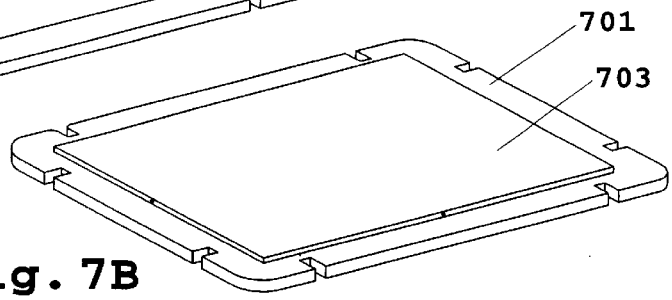

The injection molding manufacturing method creates a back piece 700 and front piece 701 of identical shape, as in FIG. 7A and FIG. 7B. FIG. 7A shows an indenture 702, for the photo to fit within. FIG. 7B shows the reverse side of the same indenture 703, as a protrusion. The two pieces, with the photo placed in the indenture, fit together, thereby holding the photo in place. Note that all corners are rounded.

Figure 7C:
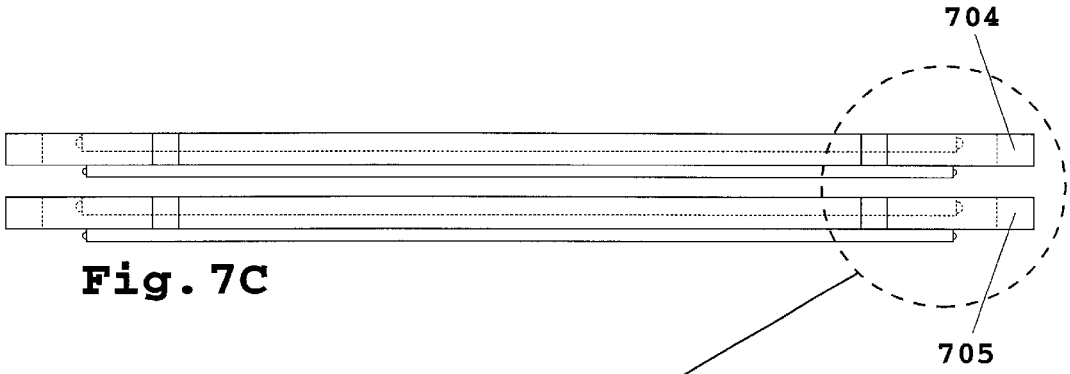

In FIG. 7C, a horizontal view of the front piece 704 and back piece 705 is seen.

Figure 7D:
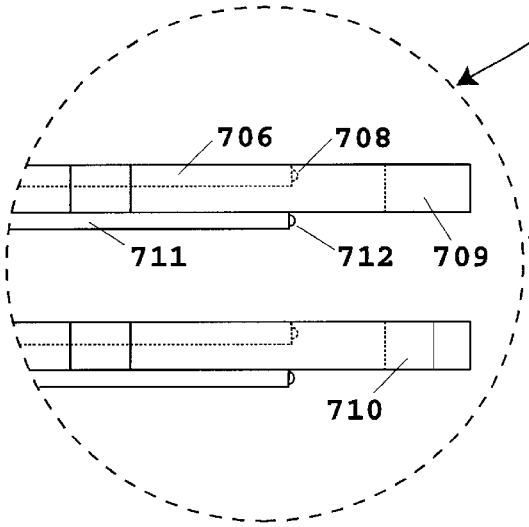

In FIG. 7D, an enlarged view of part of FIG. 7C, small dimples are shown, which hold the pieces gently together while constructing. At the end of the indenture 706, a small indented dimple 708 is shown. When the piece 709 is placed within the piece 710 below, the protrusion 711 snaps gently into place with the protruded dimple 712. These dimples are on all four sides of the indenture, roughly in the center of each side.

Figure 7E:
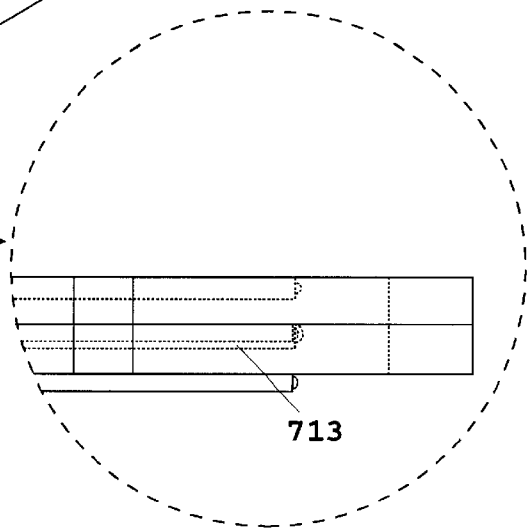

In FIG. 7E, the two pieces are shown together, with the small space 713 for the photograph indicated.

While the Operations described above are some basic configurations of the structural options, these should not be construed as limitations on the scope of the present invention, but rather as an exemplification of possible structures.

For example, structures can be created using multiples of the basic 4-frame system, in any variety of ways, only limited by the imagination of the user. While FIG. 4 shows a basic 8-frame system, which is double the basic 4-frame system viewed in FIGS. 1, 2 and 3, this basic 8-frame system can also be multiplied over and over again, and built in numerous configurations.

The advantages are:

The present invention can be built and rebuilt over and over again, in many different forms, to accommodate the user's desires in exhibiting photos;

The present invention can simultaneously exhibit horizontal and vertical photos, or exhibit photos of the same layout;

The present invention allows the photos to be used without glue, thereby leaving the photos undamaged when they are removed from the system;

The present invention can grow to accommodate as many photos as the user desires, and can then be broken down into multiple, smaller sets to be placed in different rooms of the user's home or office, easily and at will;

No tools are needed to create the structure—it is completely self-contained with the exception of the photos themselves.

The scope of the invention should be determined by the appended claims and their legal equivalents, rather than by the examples given.

I claim:

1. A modular picture frame system, comprising a) fronts and backs for the photos to sandwich between;

b) said fronts and backs are rectangular in shape, the same size as each other, and have aligning notches on each edge;

c) short and long supporting caps;

d) short caps and long caps the same length as the short and long sides of fronts and backs, and notched in corresponding fashion as a means to connect the pieces in a perpendicular fashion and build the structure;

e) said fronts and backs intersecting with said caps, thereby creating a three-dimensional, photo frame structure of variable configuration, and variable size depending upon how many photos are used.

2. A modular picture frame system as defined in claim 1 further characterized by a) a slight recession in the back piece and a like protrusion in the front piece, so that both of said pieces fit together, within which the photo can be placed;

b) slightly rounded corners on all right angles.

* * * * *